US006848688B1

(12) United States Patent
Ruthenberg et al.

(10) Patent No.: US 6,848,688 B1
(45) Date of Patent: Feb. 1, 2005

(54) AUTOMATICALLY ELEVATING SHEET TAMPER AND SHEET INPUT LEVEL FOR COMPILING LARGE PRINTED SETS

(75) Inventors: Raymond M. Ruthenberg, Toronto (CA); Robert H. Brown, Etobicoke (CA); Martyn Mitchell, Milton (CA); Jeffrey R. Hudson, Oakville (CA); Scott A. Sinclair, Burlington (CA); Robert James Douglas Reeves, Toronto (CA)

(73) Assignee: Xerox Corporation, Stamford, CT (US)

( * ) Notice: Subject to any disclaimer, the term of this patent is extended or adjusted under 35 U.S.C. 154(b) by 0 days.

(21) Appl. No.: 10/657,336

(22) Filed: Sep. 8, 2003

(51) Int. Cl.[7] ..... B65H 31/36
(52) U.S. Cl. ..... 271/221
(58) Field of Search ..... 271/207, 221, 271/200, 201, 176; 270/58.09

(56) References Cited

U.S. PATENT DOCUMENTS

| | | | | | |
|---|---|---|---|---|---|
| 4,871,158 | A | | 10/1989 | May et al. | |
| 5,098,074 | A | | 3/1992 | Mandel et al. | |
| 5,190,274 | A | * | 3/1993 | Kamamoto et al. | 270/58.09 |
| 5,253,859 | A | * | 10/1993 | Ricciardi | 271/176 |
| 5,289,251 | A | | 2/1994 | Mandel et al. | |
| 5,374,051 | A | | 12/1994 | Ulrich et al. | |
| 5,409,201 | A | | 4/1995 | Kramer | |
| 5,439,209 | A | * | 8/1995 | Runzi | 271/251 |
| 5,473,420 | A | | 12/1995 | Rizzolo et al. | |
| 5,501,442 | A | | 3/1996 | Mandel | |
| 5,513,839 | A | | 5/1996 | Green | |
| 5,516,092 | A | * | 5/1996 | Pollich | 271/221 |
| 5,599,009 | A | | 2/1997 | Mandel | |
| 5,639,078 | A | | 6/1997 | Mandel et al. | |
| 5,649,695 | A | | 7/1997 | Lawrence | |
| 5,671,920 | A | | 9/1997 | Acquaviva et al. | |
| 5,685,529 | A | | 11/1997 | McFarland | |
| 5,823,529 | A | | 10/1998 | Mandel et al. | |
| 6,003,862 | A | | 12/1999 | Russell et al. | |
| 6,257,571 | B1 | * | 7/2001 | Kniss et al. | 271/181 |

FOREIGN PATENT DOCUMENTS

| | | | | |
|---|---|---|---|---|
| JP | 62008965 A | * | 1/1987 | B65H/33/08 |
| JP | 62046862 A | * | 2/1987 | B65H/33/08 |

* cited by examiner

*Primary Examiner*—David H. Bollinger

(57) ABSTRACT

Multiple sheet set compiling in a compiler of the seriatim output of printed sheets from a printer with a sheet entry position and a lateral sheet tamping system for laterally tamping the sheets being stacked in the compiler, in which the accumulated stack height of the sheets being compiled is estimated, and in response thereto the height of the top of the lateral sheet tamping system is raised to be maintained above the top of that rising (thicker) stack in the compiler, and lowered for the initial sheets stacking, and the compiler sheet entry position is also automatically raised in proportion to the increasing height of the stack of sheets being compiled in the compiler.

7 Claims, 3 Drawing Sheets

AUTOMATICALLY ELEVATING SHEET TAMPER AND SHEET INPUT LEVEL FOR COMPILING LARGE PRINTED SETS

The disclosed embodiment provides an improved compiling system and method for compiling a sequential output of multiple printed sheets into a neatly superposed stacked set thereof, with optional finishing and with reduced tendencies for sheet jams scattering, especially for thicker multisheet sets, by increasing the height of variable height tampers and/or the sheet input level for increased thickness (height in the compiler) of the set being compiled.

By way of background, cross-process (lateral) sheet stacking registration, even with an inclined sheet compiling tray in the output of a printer, normally requires a cross-process registration system, typically a tamping system reciprocally laterally engaging the sides of the accumulating stack, or at least the sheet being fed onto the top of the stack. Some examples are in the following issued U.S. patents: U.S. Pat. No. 6,003,862 "Simplified Sheet Tamping System with Flexible Guided Tamper Drive," U.S. Pat. No. 5,823,529 "Single Stack Height Sensor for Plural Sheet Stacking Bins System," U.S. Pat. No. 5,671,920 "High Speed Printed Sheet Stacking and Registration System," U.S. Pat. No. 5,639,078 "Automatic Sheet Stacking Edge Registration Members Repositioning System with Transverse Tamper Positioning," U.S. Pat. No. 5,599,009 "Stacking Height Estimation Correction System," U.S. Pat. No. 5,513,839 "Dual Mode Set Stacking Tamper and Sheet Feeder Offset System," U.S. Pat. No. 5,501,442 "Dual Mode Tamper/Offsetter," U.S. Pat. No. 5,473,420 "Sheet Stacking and Registering Device Have Constrained Registration Belts," U.S. Pat. No. 5,374,051 "Relief Device for Offset Stacker Tamping Mechanism."

Such tamping systems need to make contact with all of the sheets of the set being compiled, and in particular to be of sufficient height to make contact with the top of the set—the sheets being stacked last. It is also known to be advantageous to place the tamping system downstream of the last media transport nip (prior to compiling) in order to improve the cross-process registration. This, however, presents a problem of the tampers being in the path of (and potential obstructing) the subsequent sheet entering the compiler area. Previous designs have mitigated this problem by forming the tampers such that they are below the sheet entry path, or by timing the tamping system such that tamping only occurs in the inter-copy gap when no sheet is entering the compiler, and otherwise retracting the tampers laterally by a substantial lateral distance away from the stack edges and out of the sheet entry path during each sheet entry into the compiling tray.

The latter prior practice takes extra space, extra rapid tamper motions, and temporarily loses lateral control over sheet stacking in the inter-copy gap time period, when the previous sheet may still be floating or settling down onto the top of the stack. Timing the tamping system in that manner can also result in an undesirable limit on the set compiling rate. Other alternatives of shaping the tampers can result in compromises as to the height of the compiler entry nip (the upstream sheet exit nip into the compiler), and/or the tamper position distance from the set registration edge.

The exemplary compiler embodiment, which may be a part of various multi-function finishers, part of a printer, or a separate module, provides a variable height sheet entry nip which can elevate based on the accumulative height of the set being compiled, and provides for the top of the side tamper(s) to be elevated in a similar and coordinated manner. With this disclosed embodiment, the tamper stays unobstructedly below the variable height incoming sheet path yet also stays above the top of the set, even as the set height substantially increases. This allows the tamper to be in an optimum position for tamping, even for larger compiled sets with more and/or thicker sheets, yet be maintained at a level which is not obstructing the sheet input path from the compiler entry nip to the top of the stack. This can allow for higher printing and set compiling rates, to 120 ppm or higher, even with a tamping system originally designed for a slower speed printer.

Further by way of background, various types of output or "finishing" systems or modules are known in the art, including those in which the output of a printer which can provide pre-collated, for example, page order printed sheets may be on-line compiled (accumulated in a superposed set) into completed sets of plural sheets, typically with at least side edge alignment jogging. The compiled sets may, or may not, be stapled or otherwise bound together and/or have covers added, be folded, or otherwise finished. Each compiled set may be automatically fed out of the compiler by closing an exit rollers nip, or by being dropped, pushed out, or otherwise stacked on a stack of previously compiled sets, typically on an automatic level elevator tray or removable container, for convenient collection and subsequent removal, or for further finisher processing. The following Xerox Corp. U.S. patent disclosures, and other art cited therein, are noted merely by way of some examples: U.S. Pat. No. 5,098,074 issued Mar. 24, 1992; U.S. Pat. No. 5,289,251 issued Feb. 22, 1994; U.S. Pat. No. 5,409,201 issued Apr. 25, 1995; U.S. Pat. No. 5,685,529 issued Nov. 11, 1997; U.S. Pat. No. 4,871,158 issued Oct. 3, 1989; and U.S. Pat. No. 5,649,695.

The sheet handling system embodiment disclosed herein provides improved sheet alignment and stacking control, with productivity suitable for high volume finishing, for example more than 100 ppm. It can handle a wide range of weight, condition and beam strength sheets. It can enable "on line" compiling and finishing of relatively large sets of sheets, for example, 100 or more, received, directly seriatim (sequentially) from the output of even a high speed printer, or various other document creating apparatus. Their output of seriatim printed sheets may be accumulated and neatly stacked until the desired number of sheets for that set (for example, all the pages of a collated document) is accumulated (compiled).

One specific feature of the specific embodiment(s) disclosed herein is to provide an improved sheet set compiling method for compiling the seriatim output of printed sheets into sets of multiple sheets, in which multiple sheets are fed seriatim into a compiler from a sheet entry position and stacked therein, and in which a lateral sheet tamping system is provided for laterally tamping said sheets being fed into said compiler from said sheet entry position, comprising, automatically estimating the height of the stack of sheets being compiled in said compiler, and in response thereto, and automatically maintaining the height of said lateral sheet tamping system above the height of the stack of sheets being compiled in said compiler by movement of at least a part of said lateral sheet tamping system.

Further specific features disclosed in the embodiment(s) herein, individually or in combination, include those wherein said compiler sheet entry position is automatically raised in proportion to the height of the stack of sheets being compiled in said compiler, and/or a sheet set compiler for compiling the seriatim output of printed sheets into sets of multiple sheets, including a sheet input system through which multiple sheets are fed seriatim into said compiler to be stacked therein, and including a lateral sheet tamping system for laterally tamping said sheets being fed into said compiler from said sheet entry position, comprising, means for automatically estimating the height of the stack of sheets being compiled in said compiler, and said lateral sheet tamping system having a variable height and means for automatically maintaining said variable height of said lateral sheet tamping system above the height of the stack of sheets being compiled in said compiler, and/or wherein said sheet input system is automatically raisable relative to increases in the height of the stack of sheets being compiled in said compiler, and/or a sheet set compiler for compiling the seriatim output of printed sheets into sets of multiple sheets, including a sheet input system through which multiple sheets are fed seriatim into said compiler to be stacked therein, and including a lateral sheet tamping system for laterally tamping said sheets being fed into said compiler from said sheet entry position, comprising, a stack height estimation system providing an electrical signal proportional to the current height of the stack of sheets being compiled in said compiler, and said lateral sheet tamping system having a maximum height adjustment system controlled by said electrical signal for automatically maintaining said maximum height of said lateral sheet tamping system above said current height of the stack of sheets being compiled in said compiler, and/or wherein said lateral sheet tamping system comprises a pair of opposing and vertically extending stack edge tampers, and wherein said maximum height adjustment system comprises the motor driven pivoting of said stack edge tampers, and/or wherein said sheet input system comprises a vertically repositionable sheet feeding nip which is automatically vertically repositioned upwardly relative to increases in the height of the stack of sheets being compiled in said compiler.

The disclosed system may be operated and controlled by appropriate operation of conventional control systems. It is well known and preferable to program and execute imaging, printing, paper handling, and other control functions and logic with software instructions for conventional or general purpose microprocessors, as taught by numerous prior patents and commercial products. Such programming or software may of course vary depending on the particular functions, software type, and microprocessor or other computer system utilized, but will be available to, or readily programmable without undue experimentation from, functional descriptions, such as those provided herein, and/or prior knowledge of functions which are conventional, together with general knowledge in the software or computer arts. Alternatively, the disclosed control system or method may be implemented partially or fully in hardware, using standard logic circuits or single chip VLSI designs.

The alternative terms "reproduction apparatus" or "printer" as used herein broadly encompasses various printers, copiers or multifunction machines or systems, xerographic or otherwise, unless otherwise defined in a claim. The term "sheet" herein refers to a usually flimsy physical sheet of paper, plastic, or other suitable physical substrate for images, whether precut or web fed.

As to specific components of the subject apparatus or methods, or alternatives therefor, it will be appreciated that, as is normally the case, some such components are known per se in other apparatus or applications, which may be additionally or alternatively used herein, including those from art cited herein. For example, it will be appreciated by respective engineers and others that many of the particular component mountings, component actuations, or component drive systems illustrated herein are merely exemplary, and that the same novel motions and functions can be provided by many other known or readily available alternatives. All cited references, and their references, are incorporated by reference herein where appropriate for teachings of additional or alternative details, features, and/or technical background. What is well known to those skilled in the art need not be described herein.

Various of the above-mentioned and further features and advantages will be apparent to those skilled in the art from the specific apparatus and its operation or methods described in the example below, and the claims. Thus, the present invention will be better understood from this description of this specific embodiment, including the drawing figures (which are approximately to scale) wherein:

Figure 1:
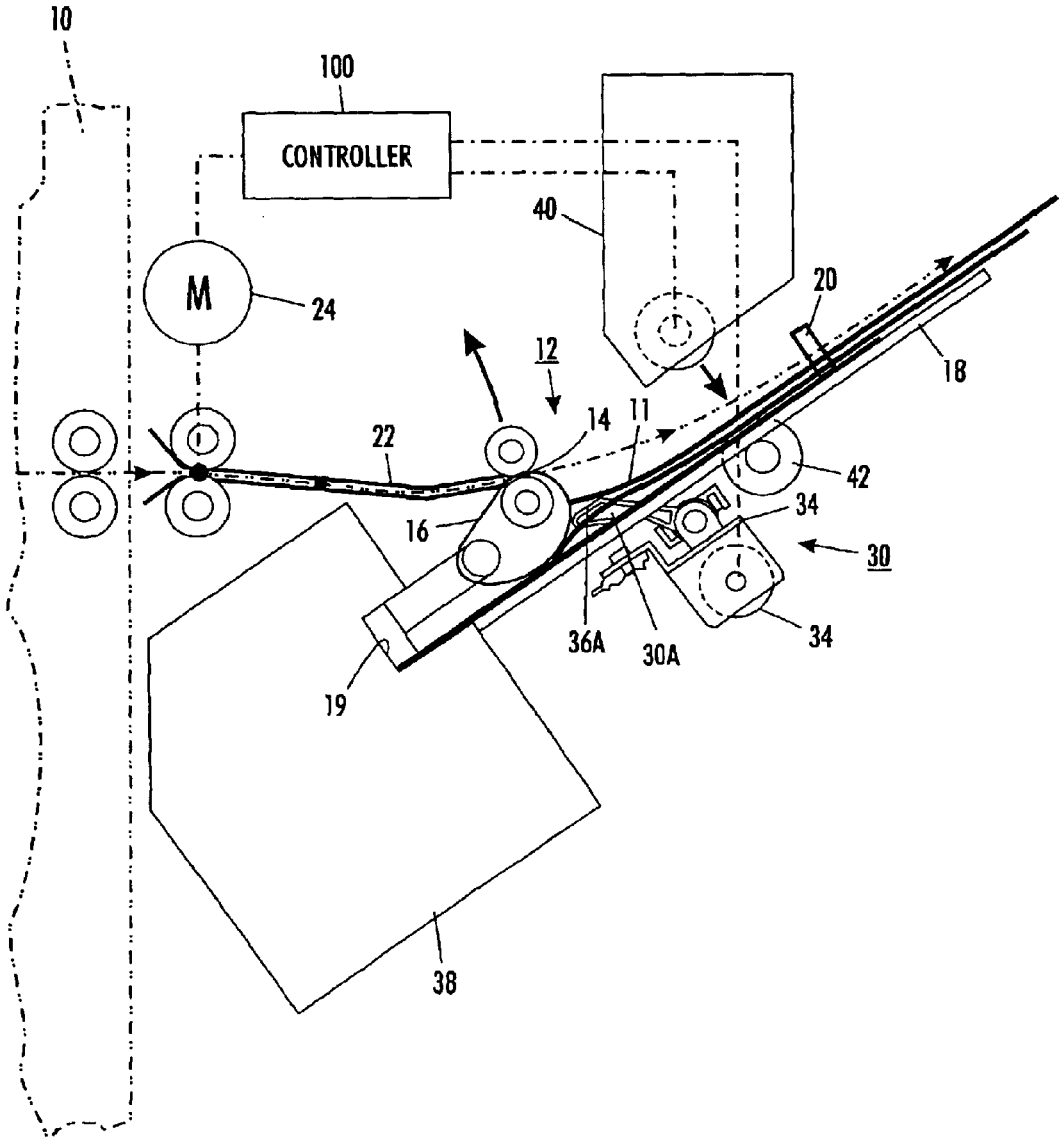
FIG. 1 is a partially schematic side view of one example of a compiler with an automatically variable height tamper system and sheet input level system for the printed sheets output of a printer; showing the start of compiling of a sheets set in the compiler tray.

Describing now in further detail the exemplary embodiment with reference to the Figures, there is shown by a labeled representation a printer or other reproduction machine 10 sequentially feeding printed print media sheets 11 to a multiple sheets set compiler 12 illustrating one example of the subject system and method. The sheets 11 are fed into the compiler by an otherwise conventional sheet feeding input nip 14 (also rotating one or more large floppy sheet jogging or compiling belts 16), as described in various of the above-cited patents, except that this sheet input nip 14 has a varying height or level of sheet input, as will be further described. This particular compiler 12 example has a downwardly sloping compiler tray 18, which provides in a know manner gravity assisted downhill sheet stacking back under the compiling belt or belts 16 towards a downhill trail edge registration wall, gate, or backstop 19. The sheet input nip 14 is adjacent this lower end of the compiler tray 18.

As the accumulating sheet stack height in the compiler tray 18 increases with the addition of more incoming sheets 11, that increased stack height may be sensed by a conventional stack height sensor 20, such as those with a movable mechanical flag or arm triggering an optical switch, which stack height sensor 20 may be mounted on a same pivotal unit 22 on which the sheet feeding input nip 14 is mounted here. Actuation of the stack height sensor 20 may activate a stepper motor 24 to pivot with a cam or other drive the pivotal unit 22 about its axis of rotation, such as with a four bar linkage, so as to raise up the sheet feeding input nip 14 in proportion to the increase in stack height, incrementally or continuously. This can improve the compiler sheet input feeding and stacking, especially for larger compiled set sizes. It will be appreciated by those skilled in the art that the stack height could alternatively be estimated, without requiring a stack height sensor, from the known count of the sheets to be fed into the compiler tray for that set, and/or fed in at that point in time (which information is conventionally known by the controller 100 from the document set size or number of pages and/or the printer 10 print job and paper path tracking systems), especially if the paper basis weight is also known, from operator inputs, sheet feed tray selections, or otherwise.

The compiler stack height information is also used to variably control the height of an otherwise conventional set stacking tamper system 30. The tamper system 30 conventionally reciprocally tamps the sides of the compiling set together by driven movement theretowards of opposing upstanding side tampers 32A, 32B, as shown by the movement arrows in FIG. 3 for example, to conventionally provide proper neatly superposed, aligned, stacking of the incoming sheets.

Figure 2:
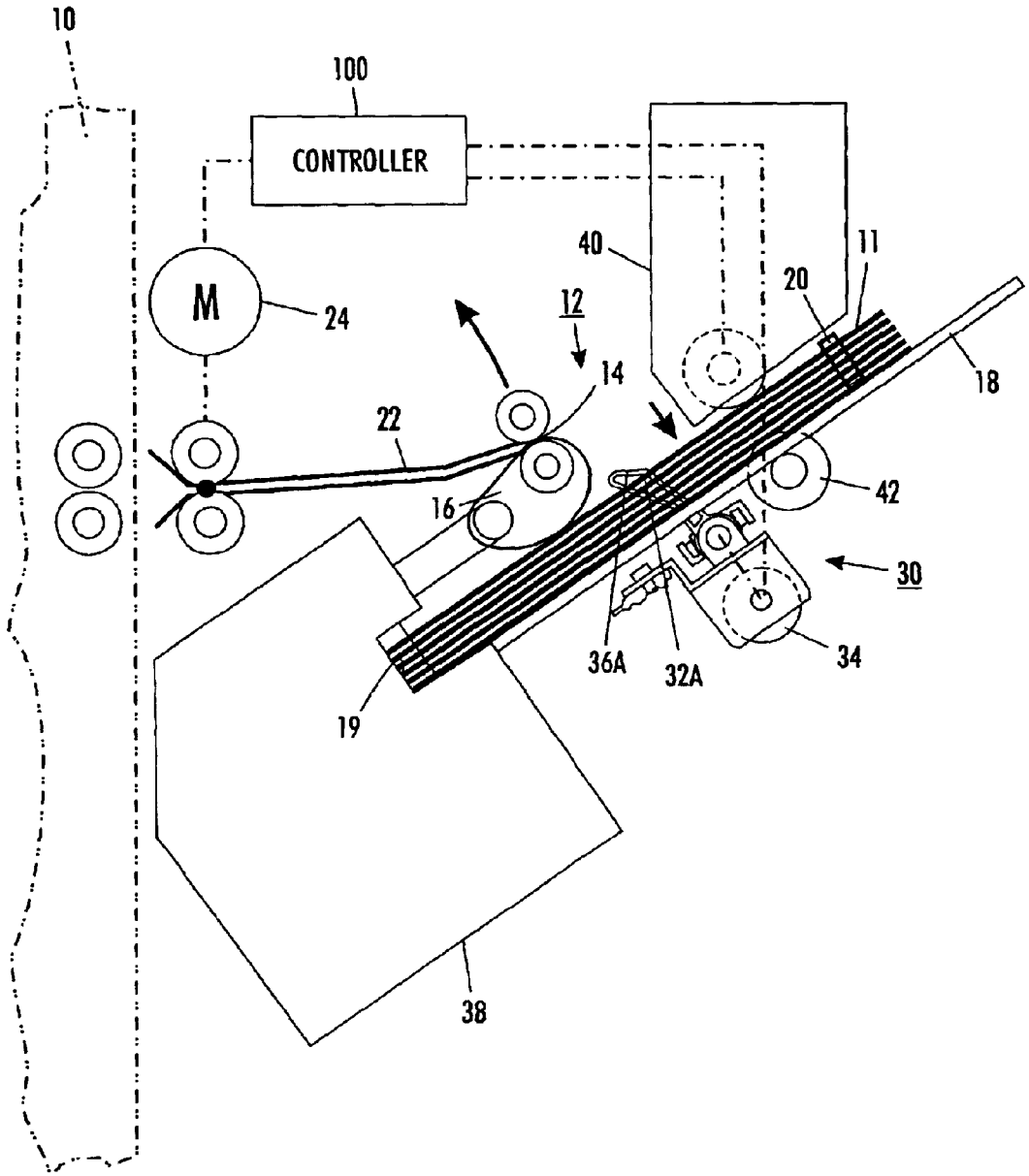
FIG. 2 is the same view as FIG. 1, illustrating the change in position of the variable height tamper system and sheet input level system for the compiling of a large number of sheets in the compiler tray.
Figure 3:
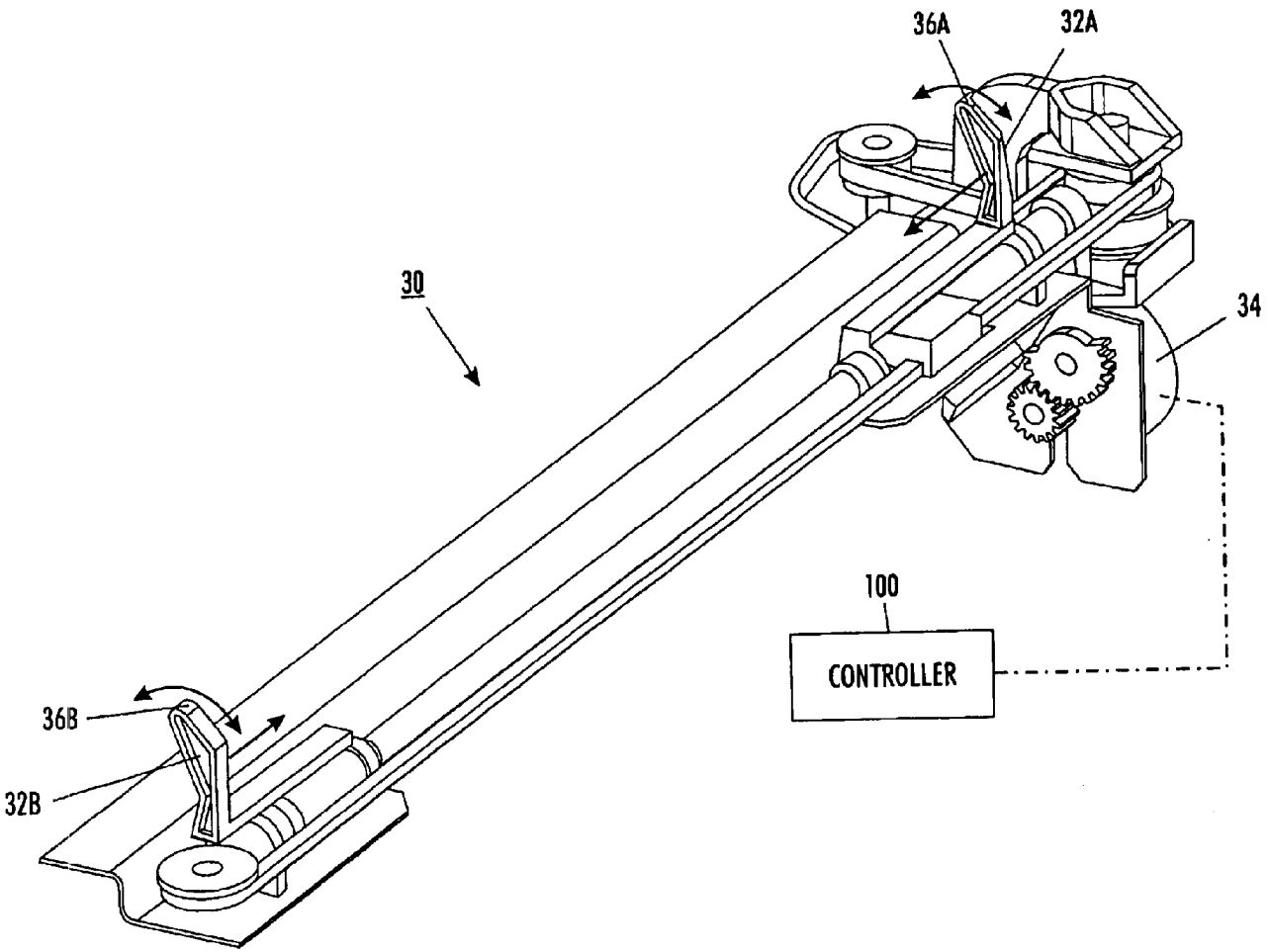
FIG. 3 is an enlarged perspective view of the automatically variable height tamper system of FIG. 1 per se.

However, here in this tamper system 30 these tampers 32A, 32B are provided with an additional movement, which may be provided by an additional motor 34 which can pivot these tampers 32A, 32B up clockwise relative to the stack as the stack increases in height so that the tops 36A, 36B of the tampers 32A, 32B will remain above the top of the stack (even for a thick stack) as shown in FIG. 2 or 3, thereby providing input sheet tamping for further sheets being stacked. Yet for the initial sheets stacking, when the stack height is low, as in FIG. 1, the tops 36A, 36B of the tampers 32A, 32B may be automatically lowered so as to be less likely to interfere with incoming sheets. As described above, this increase in the effective height of the tampers 32A, 32B is desirably done in coordination with the sheet entry nip, that is, also rising as the stack height in the compiler tray increases. That may be accomplished by a mechanical interconnection or by providing the same stack height signal from the height sensor 20 to control the motor 34 to pivot up the tampers 32A, 32B.

After the full (completed) stacked set has been compiled in the compiler tray 18, it may be optionally conventionally finished, as by stapling 38, and then the compiled set of sheets is ejected out of the compiler tray 18. Various such set ejection systems are know in the art. In this example, a set ejection unit 40 moves down and nips the compiled set with driven rollers 42 acting against other driven rollers 44 which are extending through the bottom of the compiler tray 18, as shown. This set ejection unit 40 may also automatically move up to stay out of the way of incoming sheets when a large set is being accumulated.

It will be appreciated that various of the above-disclosed and other features may be incorporated in different systems or applications. Also that various presently unforeseen or unanticipated alternatives, modifications, variations or improvements may be subsequently developed which are intended to be encompassed by the following claims.

What is claimed is:

1. An improved sheet set compiling method for compiling the seriatim output of printed sheets into sets of multiple sheets, in which multiple sheets are fed seriatim into a compiler from a sheet entry position and stacked therein, and in which a lateral sheet tamping system is provided for laterally tamping said sheets being fed into said compiler from said sheet entry position, comprising:

automatically estimating the height of the stack of sheets being compiled in said compiler, and in response to, said estimating of the height of the stack of sheets automatically maintaining the height of said lateral sheet tamping system above the height of the stack of sheets being compiled in said compiler by movement of at least a part of said lateral sheet tamping system.

2. The improved sheet set compiling method of claim 1, wherein said compiler sheet entry position is automatically raised in proportion to the height of the stack of sheets being compiled in said compiler.

3. A sheet set compiler for compiling the seriatim output of printed sheets into sets of multiple sheets, including a sheet input system through which multiple sheets are fed seriatim into said compiler to be stacked therein, and including a lateral sheet tamping system for laterally tamping said sheets being fed into said compiler from said sheet entry position, comprising:

means for automatically estimating the height of the stack of sheets being compiled in said compiler, and said lateral sheet tamping system having a variable height and means for automatically maintaining said variable height of said lateral sheet tamping system above the height of the stack of sheets being compiled in said compiler.

4. The sheet set compiler for compiling the seriatim output of printed sheets into sets of multiple sheets of claim 3, wherein said sheet input system is automatically raisable relative to increases in the height of the stack of sheets being compiled in said compiler.

5. A sheet set compiler for compiling the seriatim output of printed sheets into sets of multiple sheets, including a sheet input system through which multiple sheets are fed seriatim into said compiler to be stacked therein, and including a lateral sheet tamping system for laterally tamping said sheets being fed into said compiler from said sheet entry position, comprising:

a stack height estimation system providing an electrical signal proportional to the current height of the stack of sheets being compiled in said compiler, and said lateral sheet tamping system having a maximum height adjustment system controlled by said electrical signal for automatically maintaining said maximum height of said lateral sheet tamping system above said current height of the stack of sheets being compiled in said compiler.

6. The sheet set compiler for compiling the seriatim output of printed sheets into sets of multiple sheets of claim 5, wherein said lateral sheet tamping system comprises a pair of opposing and vertically extending pivotal stack edge tampers, and wherein said maximum height adjustment system comprises a motor pivoting said pivotal stack edge tampers.

7. The sheet set compiler for compiling the seriatim output of printed sheets into sets of multiple sheets of claim 5, wherein said sheet input system comprises a vertically repositionable sheet feeding nip which is automatically vertically repositioned upwardly relative to increases in the height of the stack of sheets being compiled in said compiler.

* * * * *